US006233824B1

(12) United States Patent
Dobbs et al.

(10) Patent No.: US 6,233,824 B1
(45) Date of Patent: May 22, 2001

(54) CYLINDRICAL HEAT EXCHANGER

(75) Inventors: Gregory M. Dobbs, Glastonbury; James D. Freihaut, South Windsor, both of CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/470,158

(22) Filed: Dec. 22, 1999

Related U.S. Application Data

(60) Provisional application No. 60/158,533, filed on Oct. 8, 1999.

(51) Int. Cl.[7] ..... B21D 53/04; F28D 7/04

(52) U.S. Cl. ..... 29/890.03; 165/164; 165/165; 165/DIG. 398

(58) Field of Search ..... 165/164, 165, 165/DIG. 398; 29/890.03

(56) References Cited

U.S. PATENT DOCUMENTS 2,360,739 * 10/1944 Strom ..... 165/165
3,705,618 * 12/1972 Jouet et al. ..... 165/DIG. 398
4,051,898 10/1977 Yoshino et al. .

(List continued on next page.)

FOREIGN PATENT DOCUMENTS

146950 * 7/1931 (CH) ..... 165/164
1376466 * 12/1974 (GB) ..... 165/164

OTHER PUBLICATIONS

Mitsubishi Electric Corporation, "Ideal Energy Savers for Room Cooling and Heating About 30% Reductionin Cooling/Heating Costs", Nov. 1993, pp. 1–12.

L.Z. Zhang et al., "Heat and mass transfer in a membrane–based energy recovery ventilator", Journal of Membrane Science 163, (1999) pp., 29–38.

Perma Pure Products, Inc., "Perma Pure Multi–tube Dryer—Model PD", Bulletin 105, 4 pages, Date Unknown.

Perma Pure Inc., "Nafion, Gas Sample Dryers", Oct. 1995, 6 pages.

Dr. Walter G. Grot, "Discovery and Development of Nafion Perfluorinated Membranes", Society for the Chemical Industry Third London International Chlorine Symposium, Jun. 5–7, 1985, 4 pages.

*Primary Examiner*—Leonard Leo
(74) *Attorney, Agent, or Firm*—Brian D. Lefort; Ronald G. Cummings

(57) ABSTRACT

Cylindrical heat exchangers are typically constructed of a plurality of spiral passageways created by multiple concentric annuluses, with increasing diameters, overlaying one another. Each passageway, however, typically includes a corrugated sheet between such circular layers, and the corrugated sheet acts as an obstruction, thereby decreasing the pressure of an air stream as it passes therethough. The present invention is a cylindrical heat exchanger having a plurality of spiral passageways created by a spirally wound rectangular sheet, wherein the overlapping spiral layers, that are formed by the winding the rectangular sheet, are spaced apart by a plurality of radially aligned dividers. The dividers, along with an open interface layer that is interposed between the spiral layers, maintain the constant gap between the spirals. Therefore, manufacturing the cylindrical heat exchanger with spiral rather than concentric layers improves the process of manufacturing such devices. Additionally, replacing the corrugated sheet with an open interface layer decreases the pressure drop of the air streams passing through the cylindrical heat exchanger, which, in turn, reduces the power consumption of a heating, ventilation and air conditioning system (HVAC) that would include the cylindrical heat exchanger.

41 Claims, 6 Drawing Sheets

U.S. PATENT DOCUMENTS

| | | | | |
|---|---|---|---|---|
| 4,089,370 | * | 5/1978 | Marchal | 165/DIG. 398 |
| 4,093,435 | | 6/1978 | Marron et al. . | |
| 4,141,412 | | 2/1979 | Culbertson . | |
| 4,267,364 | | 5/1981 | Grot et al. . | |
| 4,460,388 | | 7/1984 | Fukami et al. . | |
| 4,475,589 | | 10/1984 | Mizuno et al. . | |
| 4,546,826 | * | 10/1985 | Zitzmann | 165/164 X |
| 4,574,872 | | 3/1986 | Yano et al. . | |
| 4,621,684 | | 11/1986 | Delahunty . | |
| 4,666,468 | | 5/1987 | Wu . | |
| 4,699,206 | | 10/1987 | Kirchmeier . | |
| 4,844,719 | | 7/1989 | Toyomoto et al. . | |
| 5,118,327 | | 6/1992 | Nelson et al. . | |
| 5,527,590 | | 6/1996 | Priluck . | |
| 5,584,341 | | 12/1996 | Sabin et al. . | |
| 5,620,500 | | 4/1997 | Fukui et al. . | |
| 5,679,467 | | 10/1997 | Priluck . | |
| 5,681,368 | | 10/1997 | Rahimzadeh . | |
| 5,771,707 | | 6/1998 | Lagaceet et al. . | |
| 5,785,117 | | 7/1998 | Grinbergs . | |
| 5,816,315 | | 10/1998 | Stark . | |
| 5,909,767 | | 6/1999 | Batt . | |
| 5,913,360 | | 6/1999 | Stark . | |
| 5,915,469 | | 6/1999 | Abramzon et al. . | |
| 5,962,150 | | 10/1999 | Priluck . | |

* cited by examiner

CYLINDRICAL HEAT EXCHANGER

CROSS REFERENCE TO RELATED APPLICATIONS

This application claims benefit of U.S. Provisional Application Ser. No. 60/158,533, filed Oct. 8, 1999.

TECHNICAL FIELD

This invention relates to a cylindrically shaped heat exchanger and more particularly, to a cylindrically shaped spiral heat exchanger that minimizes the pressure drop of the air streams as they pass through the passageways.

BACKGROUND ART

Heating, ventilation and air conditioning (HVAC) systems typically exhaust a portion of the re-circulating air and simultaneously replace such exhaust air with fresh air. In order to maintain an air temperature and humidity level, within a certain space, at or near a set point, it is desirable to suitably condition the fresh air to a temperature below or above set point. Unfortunately, the temperature and humidity of fresh air often differ substantially from those of the set point. For example, during hot and humid periods, such as the summer months, the incoming fresh air typically has a higher temperature and/or humidity level than desired. Additionally, during cold and/or dry periods, such as the winter months, the incoming fresh air typically has a lower temperature and humidity level than desired. The HVAC system must, therefore, condition the fresh air before introducing it to the room.

HVAC systems are typically designed according to the worst climatic conditions for the geographic area in which the HVAC system will be located. Such worst case climatic conditions are referred to as a cooling or heating "design day." Conditioning the fresh air during such extreme climatic conditions creates a significant load on the HVAC system. System designers, therefore, typically design the HVAC system with sufficient capacity to maintain the set point during design day conditions. Such a HVAC system may include oversized equipment or include ventilators in order to operate effectively during such design day conditions. A ventilator typically includes an air-to-air heat exchanger, which creates alternating flow passages for the fresh air stream and exhaust air stream to pass therethrough, thereby transferring sensible and/or latent heat from one air stream to the other. Transferring heat between air streams reduces the load on the HVAC system and decreases its capacity requirements, which, in turn, allows the designers to specify lower capacity cooling or heating equipment, thereby leading to a more efficient design.

The air-to-air heat exchanger may be a plate-type heat exchanger or a cylindrical heat exchanger. Plate-type heat exchangers are typically constructed of a plurality of parallel plates that form alternating parallel or perpendicular passageways between such plates. If the alternating flow passages are perpendicular to one another, then the heat exchanger is referred to as a cross flow heat exchanger. Alternatively, if the flow passages are parallel to one another, then the heat exchanger is referred to as a co-flow or counter flow heat exchanger, depending upon the direction of the air streams. Counter flow heat exchangers are typically more efficient than cross flow heat exchangers. However, because the types of manifolds that are required to include a counter flow plate-type heat exchanger within a ventilator are typically complicated, most ventilators include cross flow plate-type heat exchangers. Thus, utilizing a counter flow plate-type heat exchanger may be more effective than a cross flow design, but the additional cost of the manifolding for the counter flow design may not justify the incremental improvement in performance.

Cylindrical heat exchangers are typically constructed of a plurality of annular passageways created by multiple welded circular layers that are concentric about the center of the cylindrical heat exchanger. Such layers typically create an efficient counter flow design in that one air stream enters one end and another air stream enters the other end and both air streams exit ends opposite those from which they entered the cylindrical heat exchanger. The annular passageways often include a continuous corrugated sheet therein. However, the continuous corrugated sheet could significantly decrease the pressure of the air stream as it passes through the passageway such that the resulting pressure drop of the air stream is undesirable. Moreover, the inclusion of the continuous corrugated sheet within the passageways could necessitate increasing the size of the HVAC's air handling equipment, along with its energy consumption, such that adding a ventilator to an HVAC system removes the cost benefit of including a ventilator within such a system.

Regardless of whether the heat exchanger is a plate-type or cylindrical heat exchanger, the ventilator is considered a heat recovery ventilator (HRV) or an energy recovery ventilator (ERV). Determining whether a ventilator is a HRV or an ERV is dependent upon the material from which the flat or circular plates are constructed. Moreover, such a determination is dependent upon whether the flat or circular plates are capable of transferring sensible heat or both sensible and latent heat. Specifically, if the plates or circular layers are constructed of a material that is only capable of transferring sensible heat, then the ventilator is referred to as a HRV. If, however, the plates or circular layers are constructed of a material that is capable of transferring latent heat, as well as sensible heat, then the ventilator is referred to as an ERV. For example, metal plates, such as aluminum plates, absorb a portion of the thermal energy in one air stream and transfer such energy to the other air stream by undergoing a temperature change without allowing any moisture to pass therethrough. Therefore, a ventilator constructed of metal plates is referred to as a HRV. Although plates constructed of paper typically have a lower thermal conductivity than metal, paper may be capable of transferring sensible heat because it is capable of transferring moisture between air streams. A ventilator having plates constructed of a material capable of transferring moisture between air streams is capable of transferring latent heat and is, therefore, referred to as an ERV.

It is generally understood that an ERV is more versatile and beneficial than an HRV. However, materials such as paper limit the plate's ability to transfer a larger portion of the latent heat from one air stream to the other air stream. Therefore, it is desirable to produce an ERV with a plate having a greater latent heat transfer capability. The cost of the more efficient material, however, cannot disrupt the cost benefit of including an ERV within a HVAC system. As discussed hereinbefore, utilizing a ventilator to precondition the fresh air permits selection of a lower capacity chiller or heater for the HVAC system. Specifically, preconditioning the fresh air allows the system designers to utilize a design day having more moderate parameters, which, in turn, make possible the inclusion of smaller, less costly equipment. Such equipment will also consume less energy, thereby making it less expensive to operate. Hence, including an ERV within a HVAC system is perceived as a low cost method for increasing the system's overall operating efficiency. However, if the cost of a more efficient plate material significantly increases the cost of the ERV, then including an ERV within a HVAC system decreases its financial benefit. Therefore, it is desirable that the plates within the plate-type heat exchanger be constructed of a low cost material, as well as a material that has the ability to effectively transfer latent heat.

What is needed is a cylindrical heat exchanger that minimizes the additional pressure drop of an HVAC system when such a heat exchanger is added to the system. Also, what is needed is a cylindrical heat exchanger having passageways separated by layers that are constructed of a cost effective material, other than paper, and that is capable of transferring a larger percentage of the available latent heat in one air stream to the other air stream.

DISCLOSURE OF INVENTION

The present invention is a cylindrical heat exchanger having a plurality of spiral passageways created by a spirally wound rectangular sheet, wherein the overlapping spiral layers, that are formed by the winding the rectangular sheet, are spaced apart by a plurality of radially aligned dividers. The cylindrical heat exchanger of the present invention not only provides an efficient counter flow design, which allows two opposing air streams to pass through alternating spiral passageways, but the spiral passageways include minimal obstructions therein. Reducing the obstructions within the spiral passageways reduces the pressure drop of the air streams as they pass through the cylindrical heat exchanger, which, in turn, reduces the power consumption of the HVAC system.

The present invention minimizes the obstructions within the spiral passageways by including a moderately open interface layer between the spiral layers. One embodiment of the present invention comprises an interface layer that is a grid-type structure, which includes an array of separators connected by a plurality of strands. The interface layer is situated between the dividers, such that when the rectangular sheet is wound, the interface layer assists the dividers in spacing apart the spiral layers. Therefore, it is preferable for the height of the separators to be equal to the height of the dividers. In other words, the thickness of the spiral passageway is constantly equal to the height of the separator and/or the dividers for a full spiral circumference, thereby spacing apart the overlapping spiral layers at a constant gap, Although the interface layer is a partial obstruction to the air streams passing through the passageways formed by the spiral layers, the interface layer is an open structure, which minimizes the pressure drop of such an air stream. Other suitable interface layers that have an open structure include a layer of webbed netting or a planar lattice sheet.

In addition to or an alternative to including an interface layer within the cylindrical heat exchanger, it may be preferable to increase the stiffness (i.e., rigidity) of the spirally wound rectangular sheet by placing an open support layer adjacent to the sheet or embedding the open support layer within the sheet. The support layer is either a layer of webbed netting or a planar lattice sheet. Placing a support layer adjacent to or embedding a support layer within the wound rectangular sheet increases its stiffness such that when the rectangular sheet is spirally wound, the spiral passageways created by the overlapping spiral layers retain their constant spacing.

Accordingly the present invention relates to a cylindrical heat exchanger, comprising a spirally wound rectangular sheet forming a cylindrically shaped structure having a plurality of overlapping spirally wound layers, wherein the cylindrically shaped structure has a length and a radius, and a plurality of dividers interposed between the spirally wound layers such that the dividers are radially aligned and extend along the length of the cylindrically shaped structure, whereby the dividers space apart the spirally wound layers and create overlapping substantially spiral passageways therebetween.

In an alternate embodiment of the present invention, the spirally wound rectangular sheet is constructed of an ionomer membrane, such as a sulfonated or carboxylated polymer membrane, which are capable of transferring a high degree of moisture from one of its side to the other. Because the ionomer membrane is capable of transferring a high percentage of moisture from one of its sides the other, the membrane is able to transfer a large percentage of the available latent heat in one air stream to the other air stream, thereby increasing the thermal efficiency of the cylindrical heat exchanger. Therefore, a cylindrical heat exchanger having ionomer spiral layers is more efficient than a heat exchanger with paper or metal layers.

The method of manufacturing the spiral wound configuration of the cylindrical heat exchanger is also an improvement. Specifically, polymer membranes are typically produced in a continuous sheet that is wound into a roll of film. Therefore, it is preferable to manufacture the cylindrical heat exchanger directly from such roll. Because the cylindrical heat exchanger of the present invention creates spiral passageways from overlapping spiral layers rather than annular passageways from concentric layers, the method of producing the spiral wound heat exchanger of the present invention increases manufacturing efficiency.

The foregoing features and advantages of the present invention will become more apparent in light of the following detailed description of exemplary embodiments thereof as illustrated in the accompanying drawings.

BEST MODE FOR CARRYING OUT THE INVENTION

Figure 1:
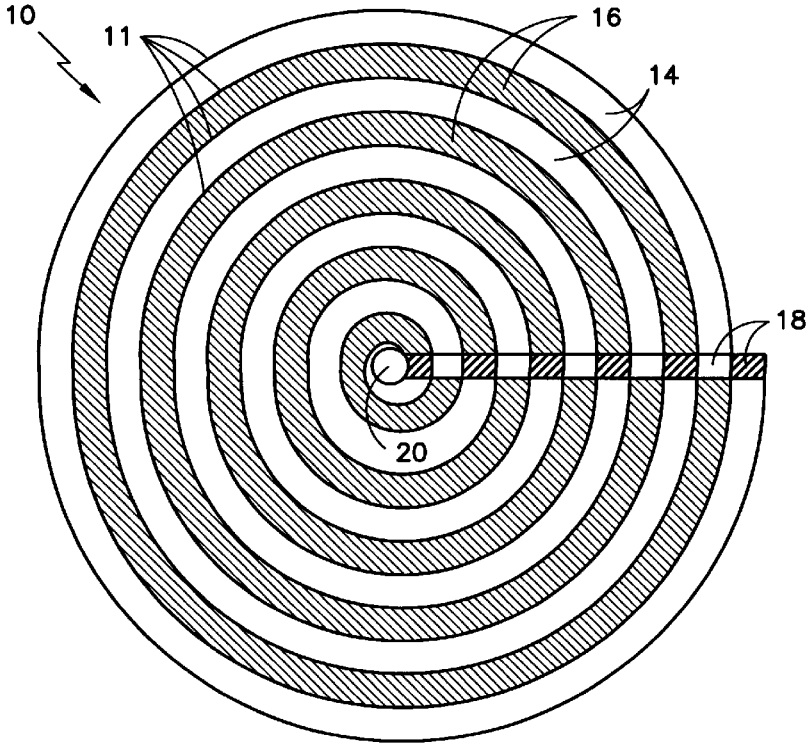
FIG. 1 is an end view of a cylindrical heat exchanger of the present invention comprising a plurality of overlapping spirals, which, in conjunction with a plurality of dividers, form a plurality of passageways.

Referring to FIGS. 1, there is shown an end view of a cylindrical heat exchanger 10 having a plurality of overlapping spirally wound layers 11 and a plurality of dividers 18 interposed between the spirally wound layers 11 such that the dividers 18 are radially aligned along a radius of the cylindrical heat exchanger 10. The dividers 18 space apart the spirally wound layers 11 at a distance equal to the height of the dividers 18 and create overlapping spiral passageways 14, 16 between the spirally wound layers 11. The spiral passageways are illustrated as alternating passageways 14, 16 in order that one air stream may enter the passageways numbered 14 at one end of the cylindrical heat exchanger 10, and an other air stream may enter the passageways numbered 16 at the other end of the cylindrical heat exchanger 10, thereby creating a counter flow heat exchanger. Although the present invention is described as a counter flow heat exchanger, is shall be understood that the present invention also applies to a co-flow heat exchanger, wherein both air streams travel in the same direction as they pass through the cylindrical heat exchanger. The dividers 18 not only serve as a means for spacing apart the spirally wound layers 11 but also serve as a means 15 for sealing one passageway 14 from another passageways 16. In other words, the dividers 18 prevent the air stream in passageway 14 from mixing with the air stream in passageway 16.

Figure 1A:
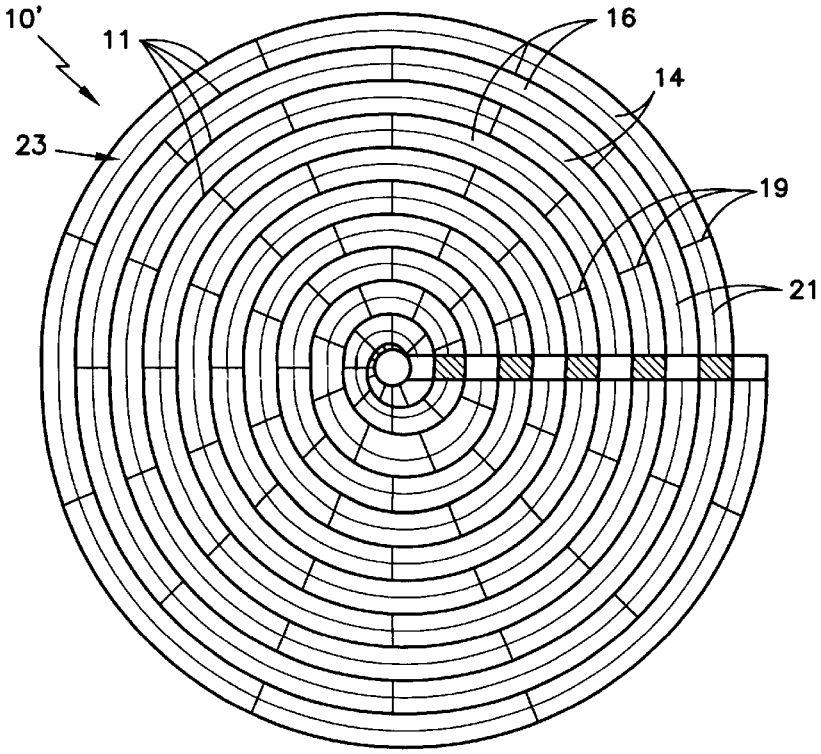
FIG. 1A is an end view of the cylindrical heat exchanger in FIG. 1 further illustrating an interface layer between overlapping spirals layers.

Referring to FIGS. 1A, there is shown an alternate embodiment of the cylindrical heat exchanger 10 in FIG. 1. Specifically, the cylindrical heat exchanger 10' in FIG. 1A further includes an interface layer 23 interposed between the spirally wound layers 11. The interface layer 23 includes a plurality of separators 19 that assist the dividers 18 in spacing apart the spirally wound layers 11.

Figure 2:
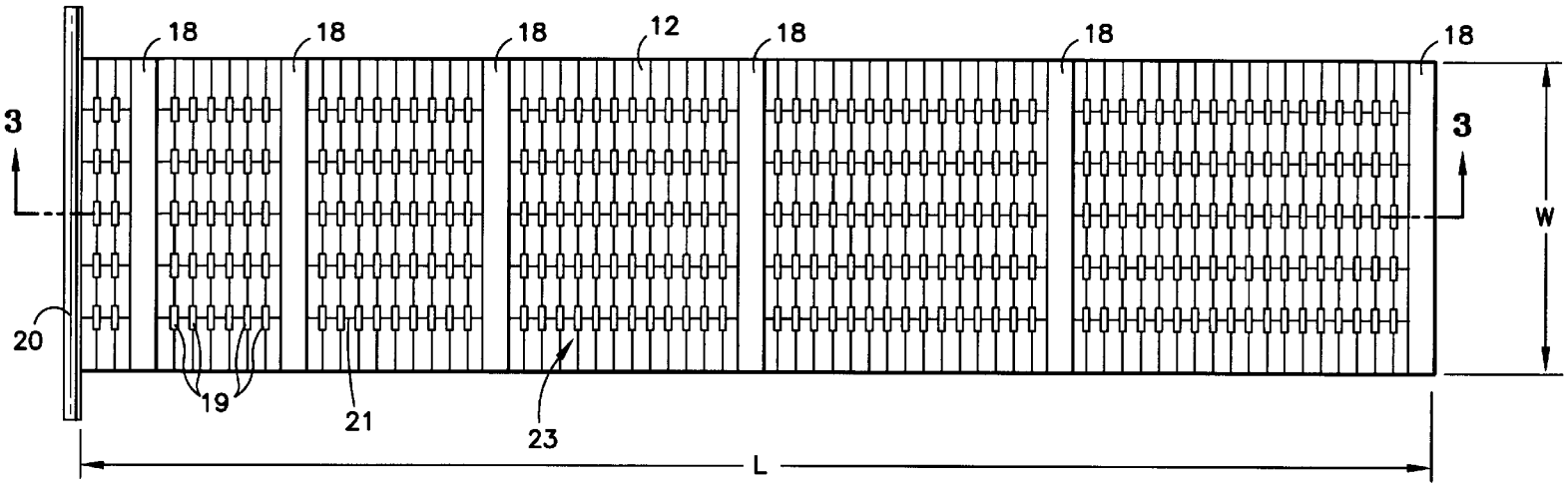
FIG. 2 is a top view of a rectangular sheet with a plurality of aperiodically spaced dividers thereon and a plurality of separators between such dividers.
Figure 3:
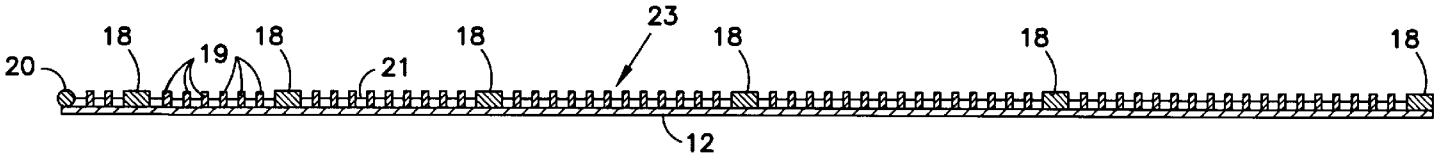
FIG. 3 is a cross-sectional view of the rectangular sheet in FIG. 2 taken along line 3–3.

Referring to FIGS. 2 and 3, the cylindrical heat exchanger 10' in FIG. 1A is constructed from a rectangular sheet 12 having a length (L) and a width (W), and the width of the rectangular sheet 12 is equal to the length of the cylindrical heat exchanger 10'. A rod 20 (or tube) is attached to one end of the length (L) of the rectangular sheet 12, and the rod 20 is parallel to and extends across the width (W) of the rectangular sheet 12 or longer thereto. The dividers 18 are aperiodically spaced along the length (L) of rectangular sheet 12 and extend across its width (W). The aperiodicity of the spacing of the dividers 18 is such that when the rectangular sheet 12 is wound in a lengthwise direction, beginning at the end with the rod 20, the dividers 18 align in a radial direction when interposed between the spirally wound layers 11. In other words, as the dividers 18 are placed upon the rectangular sheet 12, they are spaced accordingly to accommodate for the increasing circumference of the spiral passageways 14, 16 as the diameter of the cylindrical heat exchanger 10 increases during winding of the rectangular sheet 12.

It is also preferable that an open interface layer 23 be placed between the dividers 18 and on top of the rectangular sheet 12, such that when the rectangular sheet 12 is wound, the interface layer 23 is between the spirally wound layers 11. Because the interface layer 23 shall be wound, it is preferable that it be flexible. Including an interface layer 23 within the cylindrical heat exchanger 10' assists the dividers 18 in spacing apart the spiral layers 11. Situating an interface layer 23 between the spiral layers 11 maximizes cross section of passageways 14, 16. Although the interface layer is a partial obstruction to the air streams passing through the passageways 14, 16 formed by the spiral layers 11, the interface layer 23 is an open structure, which minimizes the pressure drop of such air streams.

Continuing to refer to FIG. 2 and 3, in one embodiment of the present invention, the interface layer 23 is a grid-type structure, which includes an array of separators 19 connected by a plurality of strands 21. The grid-type structure is situated between the dividers 18 and on top of the rectangular sheet 12, such that when the rectangular sheet 12 is wound, the grid-type structure assists in spacing apart the spiral layers 11. Therefore, it is preferable for the height of the separators 19 to be equal to the gap between the spiral layers 11. Including the grid-type structure within the cylindrical heat exchanger 10' assures that the thickness of the spiral passageway 11 will be constantly equal to the height of the separators 19 and/or the dividers 18 for a full spiral circumference, thereby spacing apart the overlapping spiral layers 11 at a constant gap.

Figure 5:
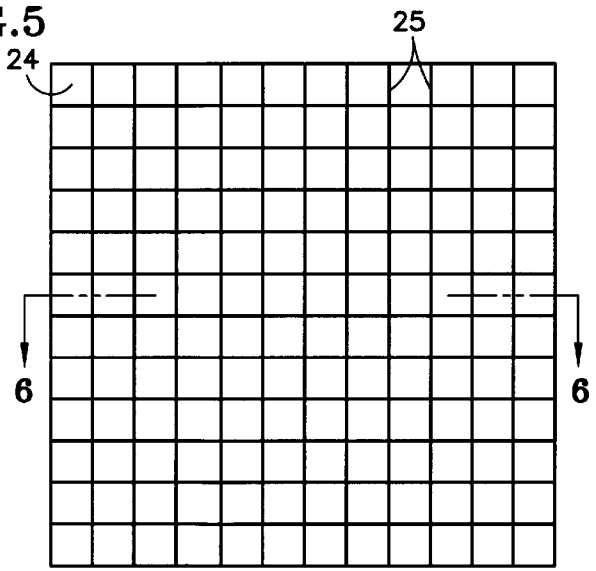
FIG. 5 is a top view of a webbed sheet.
Figure 6:
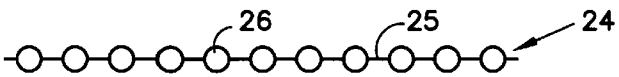
FIG. 6 is a cross-sectional view of the webbed sheet in FIG. 5 taken along line 6—6.

Referring to FIG. 5 and 6, there is shown an alternate embodiment of the interface layer 23. Specifically, the interface layer 23 is a layer of webbed netting 24. Referring to FIG. 6, which is a cross-sectional view of the webbed netting 24 taken along line 6—6 of FIG. 5, the webbed netting 24 includes a plurality of nodal points 26, which serve as the interconnection points for the multiple strands 25. The webbed netting 24 is typically constructed of plastic, but the webbed netting 24 may also be constructed of metal wire or other types of rigid strands. The strand thickness, nodal size, and the spacing between the nodes are appropriately chosen to maximize the rectangular sheet's surface area that is exposed to the air stream. However, it is preferable that the nodal size be designed such that it is equal to the height of the dividers 18. Appropriately sizing the nodal points 26 assists the dividers 18 in maintaining the constant gap between the spiral layers 11.

In an alternate embodiment of the present invention, the interface layer may be constructed of a planar lattice sheet discussed hereinafter. Although the interface layer is a partial obstruction to the air streams passing through the passageways, the interface layer is an open structure in comparison the currently utilized corrugated sheets. Therefore, including an open interface layer between the spirally wound layers decreases the pressure drop of the air streams as they pass through the passageways in comparison to including the prior art corrugated sheets. Additionally, portions of the open interface layer, such as the separators and the strands connecting the separators, assist in mixing the air, thereby increasing the effectiveness of the heat exchanger.

The rectangular sheet 12 may be constructed of metal, paper, or plastic. However, it is preferable that the rectangular sheet 12 be constructed of a material having a high moisture transfer capability, such as, an ionomer membrane. An ionomer membrane shall mean a membrane composed of an ion containing polymer, such as a sulfonated polymer membrane or a carboxylated polymer membrane that is capable of transferring moisture from one of its sides to the other. A sulfonated polymer membrane shall mean a layer of polymer comprising a sulfonated ion ($SO_3^-$) within its chemical structure. The sulfonated ion ($SO_3^-$) is typically located within the side chain of a polymer having a perfluoronated or hydrocarbon backbone structure. Examples of a generic chemical structure for a sulfonated polymer membrane comprising a perfluoronated backbone chemical structure includes the following:

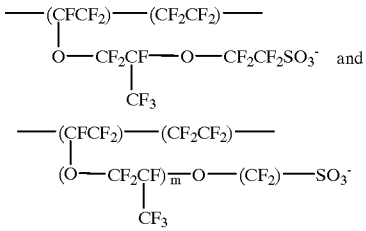

wherein, m and n are comparable variables, and;

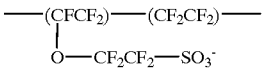

Moreover, examples of commercially available sulfonated polymer membranes having a perfluoronated chemical structure include those membranes manufactured by W. L. Gore & Associates, Inc., of Elkton, Md. and distributed under the tradename GORE-SELECT and those perfluoronated membranes manufactured by E. I. du Pont de Nemours and Company and distributed under the tradename NAFION.

An example of a generic chemical structure for a sulfonated polymer membrane comprising a hydrocarbon backbone chemical structure includes the following:

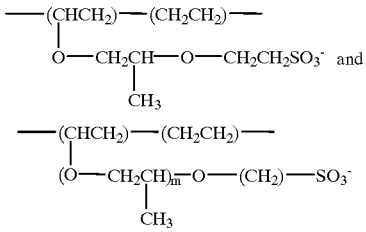

wherein, m and n are comparable variables, and;

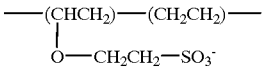

Moreover, an example of a commercially available sulfonated polymer membrane having a hydrocarbon backbone chemical structure includes the polymer membrane manufactured by the Dais Corporation, of Odessa, Fla., and distributed under the product name DAIS 585. The cost of sulfonated polymer membranes comprising a hydrocarbon backbone chemical structure is currently about one percent (1%) to ten percent (10%) of the cost of sulfonated polymer membranes comprising a perfluoronated backbone chemical structure. Therefore, it is especially preferable for the rectangular sheet 12 to be constructed of sulfonated polymer membranes comprising a hydrocarbon backbone chemical structure because incorporating such a membrane into an cylindrical heat exchanger improves its ability to transfer latent heat from air stream to the other while minimizing its cost.

The sulfonated polymer membranes do not necessarily require a hydrocarbon or perfluoronated backbone chemical structure. Rather, the backbone could be a block or random copolymer. The desirable thickness of the sulfonated polymer membranes is dependent upon their physical properties, which are controlled by the chemical backbone structure, length of side chains, degree of sulfonation, and ionomic form (i.e., acid, salt, etc.). However, such block or random copolymer must have the ionic sulfonate group ($SO_3$). Additionally, the polymer membrane may be fully or partially sulfonated. Altering the degree of sulfonation affects the polymer membrane's ability to transfer moisture, and it is preferable to have a high degree of sulfonation within the polymer membrane while maintaining sufficient physical properties.

It may also be preferable to utilize a carboxylated polymer membrane in lieu of a sulfonated polymer membrane if the carboxylated polymer membrane is able to transfer moisture from one of its sides to the other side. A carboxylated polymer membrane shall mean a layer of polymer comprising a carboxylate ion ($CO_2^-$) within its chemical structure, wherein the carboxylate ion ($CO_2^-$) is typically located within the side chain of the polymer. An example of a generic chemical structure for a carboxylate polymer membrane would include the examples of the generic chemical structures for a sulfonated polymer membrane described hereinbefore and wherein the $SO_3^-$ ion is replaced with a $CO_2^-$ ion. Although the remainder of this discussion shall refer to sulfonated polymer membranes, it shall be understood that other ionomer membranes, such as carboxylated polymer membranes, could be used as the material from which the spiral layers 11 is constructed.

Figure 4:
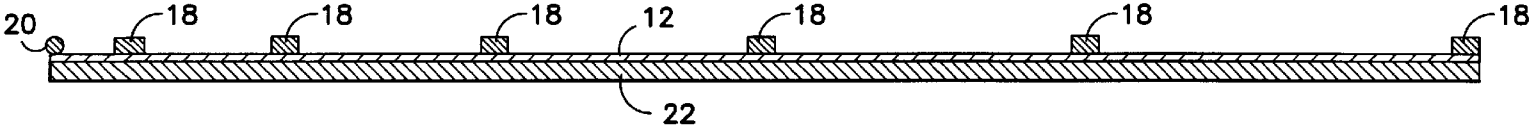
FIG. 4 is a cross-sectional view of an alternate embodiment of the rectangular sheet further comprising a support layer adjacent thereto.

In addition to or in lieu of the interface layer 23,. it may be preferable to increase the stiffness of the spiral layers 11 in order that such layers retain their spiral shape during operation, thereby preventing such layers from collapsing or fluttering as the air streams pass thereby. If the rectangular sheet 12 is constructed of a sulfonated polymer membrane, one means for assuring that the membrane has sufficient stiffness would include increasing its thickness. Increasing the thickness of the sulfonated polymer membrane, however, may decrease its ability to transfer moisture. Referring to FIG. 4, an alternate means for increasing the stiffness of the rectangular sheet 12 includes placing a support layer 22 adjacent to the rectangular sheet 12. Although the support layer 22 is illustrated as being adjacent to the bottom side of the rectangular sheet 12, it shall be understood that the support layer 22 could be adjacent to the top side of the rectangular sheet 12 or the rectangular sheet 12 could be interposed between two support layers 22.

In order to maintain the rectangular sheet's exposure to the air streams on both sides of the sheets, it is preferable that the support layer 22 be as open as possible while increasing the stiffness of the rectangular sheet 12. Referring to FIGS. 5 and 6, there is shown one type of open support layer, namely a layer of webbed netting 24 that includes an array of nodal points 26 connected by a plurality of strands 25. The strand thickness, nodal size, and the spacing between the nodes are appropriately chosen to provide the required stiffness to the sulfonated polymer membrane, while maximizing the membrane's surface area that is exposed to the air stream.

Figure 7:
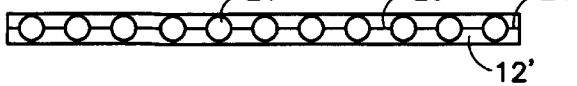
FIG. 7 is a cross-sectional view of the webbed sheet embedded within the sheet.

Referring to FIG. 7, there is shown an alternate embodiment of the present invention wherein the layer of webbed netting 24 is embedded within the rectangular sheet 12' rather than adjacent to the rectangular sheet 12. Embedding the webbed netting 24 within the rectangular sheet 12' reduces its overall thickness and increases its stiffness. Additionally, removing the support layer 22 adjacent the rectangular sheet 12 maximizes the amount of surface area that is exposed to the air stream, thereby improving the rectangular sheet's ability to transfer latent heat from one air stream to another.

Figure 8:
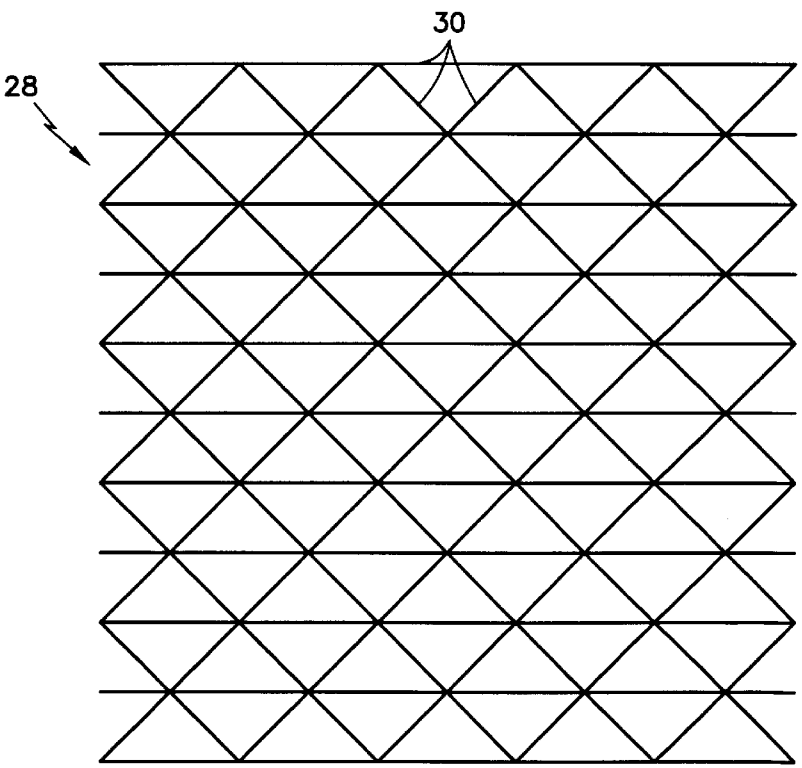
FIG. 8 is a top view of a planar lattice sheet.

Referring to FIG. 8, there is shown a planar lattice sheet 28, which can replace the layer of webbed netting 24 illustrated in FIGS. 5, 6 and 7, and serve as the support sheet 22 or be embedded within the rectangular sheet 12'. The planar lattice sheet 28 is an array of two-dimensional trigonal structures formed by overlapping segments 30 as described in U.S. Pat. Nos. 5,527,590, 5,679,467, and 5,962,150, which are hereby incorporated by reference. Similar to the layer of webbed netting 24, the planar lattice sheet 28 is an open structure that reinforces the rectangular sheet 12 while maximizing the amount of surface area that is exposed to the air stream.

Figure 9:
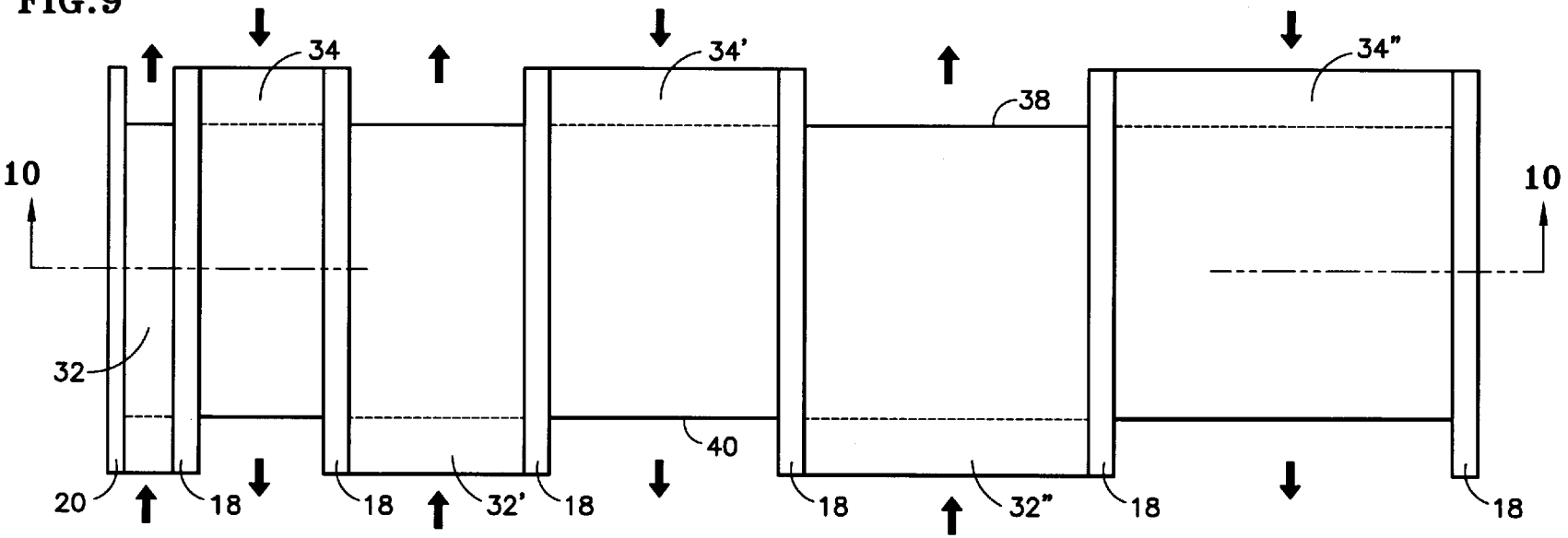
FIG. 9 is a top view of a rectangular sheet including alternating first and second manifolds placed thereon, wherein the first manifolds are aligned with one side of the rectangular sheet and overlap the other side, and wherein the second manifolds are aligned with the other side of the rectangular sheet and overlap the one side.
Figure 10:
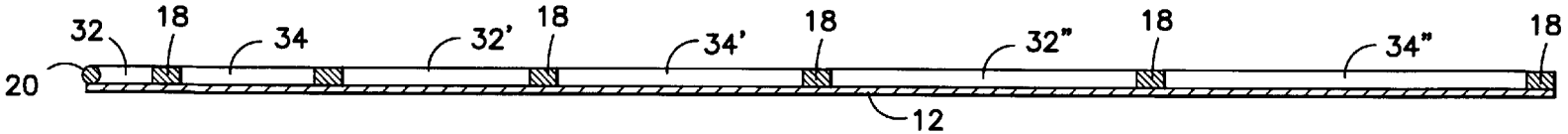
FIG. 10 is a cross-sectional view of the rectangular sheet in FIG. 9 taken along line 10—10.

Referring to FIGS. 9 and 10, in order to properly direct the entrance of air streams into the desired passageways within the cylindrical heat exchanger, it is preferable to include a series of flexible manifolds within the design of the cylindrical heat exchanger. One design includes laying a series of alternating manifolds across the width of the rectangular sheet 12 between the dividers 18. The series of manifolds numbered 32, 32', 32", etc. (hereinafter referred to as "the 32 manifold series") are flexible and align with the top edge 38 of the rectangular sheet 12 and overlap the bottom edge 40 of the rectangular sheet 12. The series of manifolds numbered 34, 34', 34", etc. (hereinafter referred to as "the 34 manifold series") are flexible and align with the bottom edge 40 of the rectangular sheet 12 and overlap the top edge 38 of the rectangular sheet 12. The 32 manifold series creates a passageway that allows an air stream to flow in one direction, and the 34 manifold series creates a passage way that allows an air stream to flow in an opposite direction, thereby creating a counter flow design. Each manifold series has the same length and are positioned over the rectangular sheet 12 such that each air stream has to travel the same distance across the length of the cylindrical heat exchanger. Therefore, this design assures that the pressure drop of each air stream will be equal as they pass through the passageways within the cylindrical heat exchanger.

Figure 11:
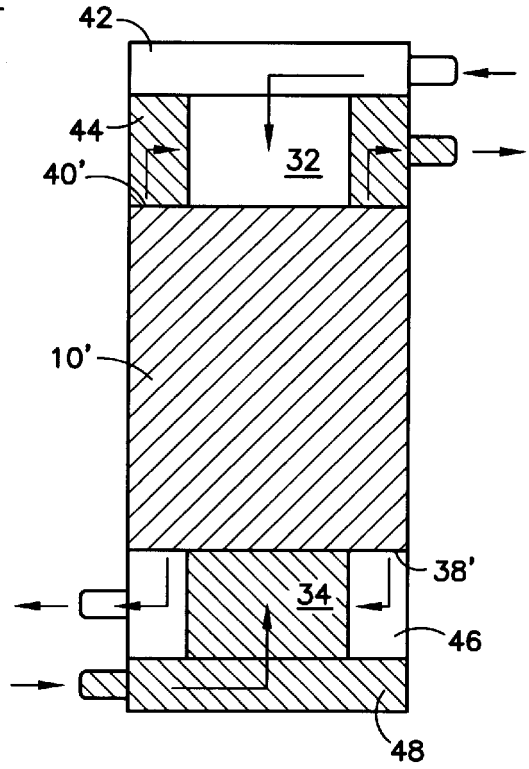
FIG. 11 is a cylindrical heat exchanger wherein one air stream enters a manifold attached to one end of the cylindrical heat exchanger and wherein a second air stream enters an other manifold attached to the other end of the cylindrical heat exchanger and wherein both air streams exit ends of the cylindrical heat exchanger opposite from which they entered the respective manifolds.

Referring to FIG. 11, as the rectangular sheet 12 in FIG. 9 is wound in a lengthwise direction, beginning with the rod 20, the 32 manifold series extends from the passageways 14 on the first end 40' of the cylindrical heat exchanger 10', and the 34 manifold series extends from the passageways 16 on the second end 38' of the cylindrical heat exchanger 10'. The first end 40' and second end 38' of the cylindrical heat exchanger 10' shall correspond to the bottom edge 40 and top edge 38 of the rectangular sheet 12, respectively. When one air stream enters a plenum 42, that air stream enters the 32 manifold series, passes through the passageways 14 within the cylindrical heat exchanger 10', and exits the second end 38' of the cylindrical heat exchanger 10' through a plenum 46. Alternatively, when an other air stream enters a plenum 48, that other air stream enters the 34 manifold series, passes through the passageways 16 within the cylindrical heat exchanger 10', and exits the first end 40' of cylindrical heat exchanger 10' through a plenum 46.

Figure 12:
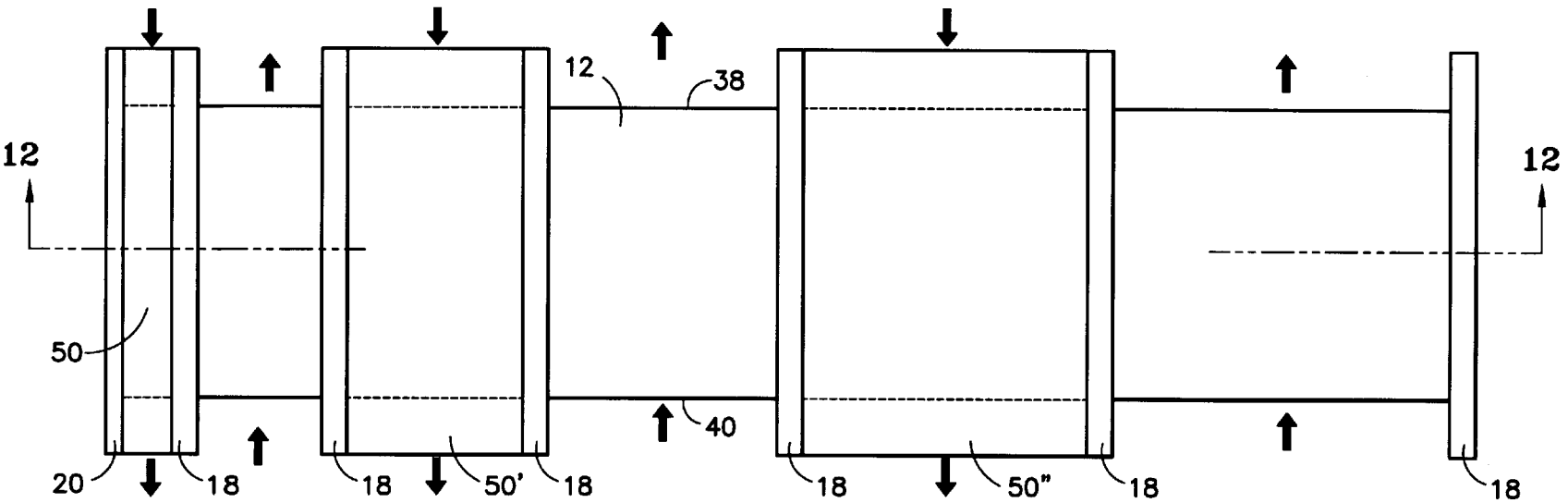
FIG. 12 is a top view of a rectangular sheet including manifolds placed thereon, wherein the manifolds overlap both sides of the rectangular sheet.
Figure 13:
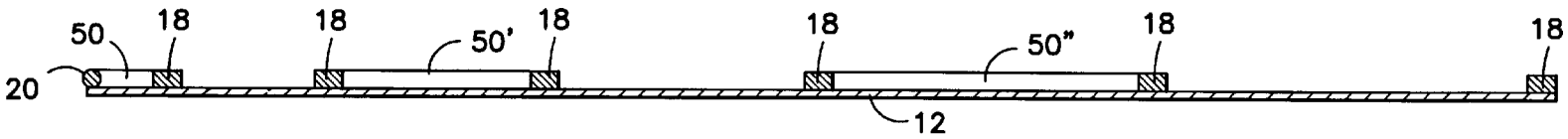
FIG. 13 is a cross-sectional view of the rectangular sheet in FIG. 12 taken along line 13—13.

Referring to FIGS. 12 and 13, there is shown an alternate manifold design. Unlike the alternating 32 and 34 manifold series in FIGS. 9 and 10, the manifold design in FIGS. 12 and 13 includes one series of manifolds. The series of manifolds numbered 50, 50', 50", etc. (hereinafter referred to as "the 50 manifold series") lay across the width of the rectangular sheet 12 between every other pair of dividers 18 and overlap both the top edge 38 and bottom edge 40 of the rectangular sheet 12. The 50 manifold series creates a passageway that allows an air stream to flow therethrough in one direction, and allows another air stream to flow through the cylindrical heat exchanger's other passageway in an opposite direction without requiring another manifold series. The air stream passing through the 50 manifold series, however, will travel a longer distance than the air stream not passing though the manifolds. Hence, the air stream passing through the 50 manifold series will experience a larger pressure drop as it passes through the cylindrical exchanger in comparison to the air stream that does not pass through the manifolds. Therefore, unlike the manifold design described in reference to FIGS. 9 and 10 above, this manifold design does not create an even pressure drop for both air streams.

Figure 14:
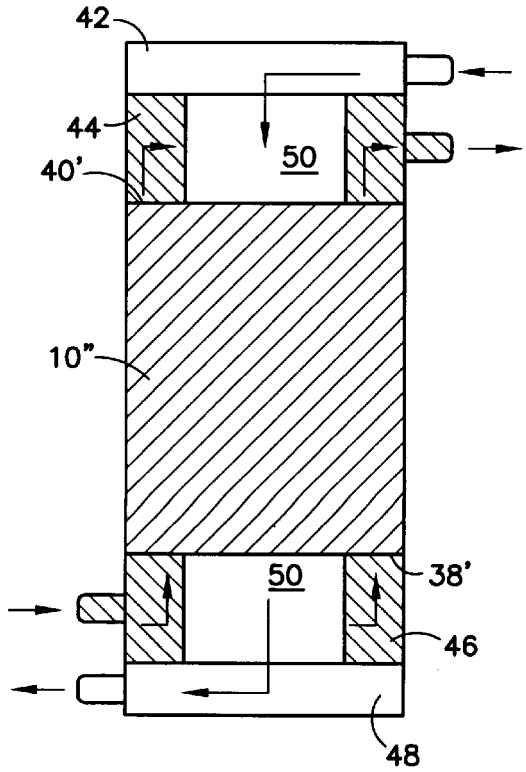
FIG. 14 is a cylindrical heat exchanger wherein one air stream enters a manifold attached to one end of the cylindrical heat exchanger and exits an other manifold attached to the other end of the cylindrical heat exchanger and wherein a second air stream enters the one end of the cylindrical heat exchanger and exits its other end.

Referring to FIG. 14, as the rectangular sheet 12 in FIG. 12 is wound in a lengthwise direction, beginning with the rod 20, the 50 manifold series extends from the passageways 14 on both the first end 40' and second end 38' of the cylindrical heat exchanger 10'. Therefore, when one air stream enters a plenum 42, that air stream enters the 50 manifold series extending from the first end 40', passes through the passageways 14 within the cylindrical heat exchanger 10', and exits the 50 manifold series extending from the second end 38' of the cylindrical heat exchanger 10' and finally through a plenum 48. Alternatively, an other air stream enters a plenum 46, enters the passageways 16 within the cylindrical heat exchanger 10' on its the second end 38' without passing through any manifold, and exits the first end 40 of cylindrical heat exchanger 10' through a plenum 44, without passing through any manifold.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A cylindrical heat exchanger, comprising:

(a) a spirally wound rectangular sheet forming a cylindrically shaped structure having a plurality of overlapping spirally wound layers, wherein said cylindrically shaped structure has a length and a radius; and (b) a plurality of dividers interposed between said spirally wound layers such that said dividers are radially aligned and extend along the length of said cylindrically shaped structure, whereby said dividers space apart said spirally wound layers and create overlapping substantially spiral passageways therebetween.

2. The cylindrical heat exchanger of claim 1 further comprising a spirally wound interface layer interposed between said spirally wound layers.

3. The cylindrical heat exchanger of claim 2 wherein said spirally wound interface layer includes an array of separators.

4. The cylindrical heat exchanger of claim 2 wherein said spirally wound interface layer is a webbed sheet.

5. The cylindrical heat exchanger of claim 2 wherein said spirally wound interface layer is a planar lattice sheet.

6. The cylindrical heat exchanger of claim 1 wherein said spirally wound rectangular sheet is an ionomer membrane.

7. The cylindrical heat exchanger of claim 6 wherein said ionomer membrane is a sulfonated polymer membrane.

8. The cylindrical heat exchanger of claim 7 wherein said sulfonated polymer membrane comprises a perfluoronated backbone chemical structure.

9. The cylindrical heat exchanger of claim 7 wherein said sulfonated polymer membrane comprises a hydrocarbon backbone chemical structure.

10. The cylindrical heat exchanger of claim 6 wherein said ionomer membrane is a carboxylated polymer membrane.

11. The cylindrical heat exchanger of claim 6 further comprising a webbed sheet embedded within said ionomer membrane.

12. The cylindrical heat exchanger of claim 6 further comprising a planar lattice sheet embedded within said ionomer membrane.

13. The cylindrical heat exchanger of claim 1 further comprising a spirally wound rectangular support layer adjacent said spirally wound rectangular sheet.

14. The cylindrical heat exchanger of claim 13 wherein said wherein said spirally wound rectangular support layer is a webbed sheet.

15. The cylindrical heat exchanger of claim 13 wherein said wherein said rectangular support layer is a planar lattice sheet.

16. A cylindrical heat exchanger, comprising:

(a) a spirally wound rectangular sheet forming a cylindrically shaped structure having a plurality of overlapping spirally wound layers, wherein said cylindrically shaped structure has a length and a radius;

(b) a plurality of dividers interposed between said spirally wound layers such that said dividers are radially aligned and extend along the length of said cylindrically shaped structure, whereby said dividers space apart said spirally wound layers and create overlapping first and second alternating substantially spiral passageways therebetween;

(c) a plurality of first manifolds extending from one end of said first spiral passageways, thereby allowing a first gas stream to pass therethrough; and (d) a plurality of second manifolds extending from an other end of said second spiral passageways, thereby allowing a second gas stream to pass therethrough.

17. The cylindrical heat exchanger of claim 16 further comprising a spirally wound interface layer interposed between said spirally wound layers.

18. The cylindrical heat exchanger of claim 16 wherein said spirally wound rectangular sheet is an ionomer membrane.

19. The cylindrical heat exchanger of claim 18 wherein said ionomer is a sulfonated polymer membrane.

20. The cylindrical heat exchanger of claim 19 wherein said sulfonated polymer membrane comprises a perfluoronated backbone chemical structure.

21. The cylindrical heat exchanger of claim 19 wherein said sulfonated polymer membrane comprises a hydrocarbon backbone chemical structure.

22. The cylindrical heat exchanger of claim 18 wherein said spirally wound rectangular sheet if a carboxylated polymer membrane.

23. A cylindrical heat exchanger, comprising:

(a) a spirally wound rectangular sheet forming a cylindrically shaped structure having a plurality of overlapping spirally wound layers, wherein said cylindrically shaped structure has a length and a radius;

(b) a plurality of dividers interposed between said spirally wound layers such that said dividers are radially aligned and extend along the length of said cylindrically shaped structure, whereby said dividers space apart said spirally wound layers and create overlapping first and second alternating substantially spiral passageways therebetween;

(c) a plurality of first manifolds extending from one end of said first spiral passageways, thereby allowing a first gas stream to enter therein; and (d) a plurality of second manifolds extending from an other end of said first spiral passageways, thereby allowing the first gas stream to exit thereout.

24. The cylindrical heat exchanger of claim 23 further comprising a spirally wound interface layer interposed between said spirally wound layers.

25. The cylindrical heat exchanger of claim 23 wherein said spirally wound rectangular sheet is an ionomer membrane.

26. The cylindrical heat exchanger of claim 25 wherein said ionomer membrane is a sulfonated polymer membrane.

27. The cylindrical heat exchanger of claim 26 wherein said sulfonated polymer membrane comprises a perfluoronated backbone chemical structure.

28. The cylindrical heat exchanger of claim 26 wherein said sulfonated polymer membrane comprises a hydrocarbon backbone chemical structure.

29. The cylindrical heat exchanger of claim 25 wherein said ionomer membrane is a carboxylated polymer membrane.

30. A method of manufacturing a cylindrical heat exchanger from a rectangular sheet having a width and a length, comprising the steps of:

(a) positioning a plurality of parallel dividers across the width of a rectangular sheet;

(b) situating the dividers aperiodically along the length of the rectangular sheet such that when the rectangular sheet is spirally wound in a lengthwise direction, the dividers are aligned in a radial direction; and (c) winding the sheet in the lengthwise direction and forming a plurality of spirally wound layers that in conjunction with the dividers, which space apart the spirally wound layers, form a plurality of overlapping substantially spiral passageways.

31. The method of manufacturing the cylindrical heat exchanger of claim 30 further comprising the step of positioning an interface layer between the dividers such that when the rectangular sheet is spirally wound in a lengthwise direction, the interface layer is interposed between the spirally wound layers.

32. The method of manufacturing the cylindrical heat exchanger of claim 30 wherein said sheet is an ionomer membrane.

33. The method of manufacturing the cylindrical heat exchanger of claim 32 wherein said ionomer membrane is a sulfonated polymer membrane.

34. The method of manufacturing the cylindrical heat exchanger of claim 33 wherein said sulfonated polymer membrane comprises a perfluoronated backbone chemical structure.

35. The method of manufacturing the cylindrical heat exchanger of claim 33 wherein said sulfonated polymer membrane comprises a hydrocarbon backbone chemical structure.

36. The method of manufacturing the cylindrical heat exchanger of claim 32 wherein said ionomer membrane comprising a webbed sheet embedded therein.

37. The method of manufacturing the cylindrical heat exchanger of claim 32 wherein said ionomer membrane comprises a planar lattice sheet embedded therein.

38. The method of manufacturing the cylindrical heat exchanger of claim 32 wherein said ionomer membrane is a carboxylated polymer membrane.

39. The method of manufacturing the cylindrical heat exchanger of claim 30 further comprising a rectangular support layer adjacent said rectangular sheet.

40. The method of manufacturing the cylindrical heat exchanger of claim 39 wherein said wherein said rectangular support layer is a planar lattice sheet.

41. The method of manufacturing the cylindrical heat exchanger of claim 39 wherein said rectangular support layer is a webbed sheet.

* * * * *